US006572758B2

(12) United States Patent
Zolotarsky et al.

(10) Patent No.: US 6,572,758 B2
(45) Date of Patent: Jun. 3, 2003

(54) ELECTRODE COATING AND METHOD OF USE AND PREPARATION THEREOF

(75) Inventors: Vadim Zolotarsky, Springfield, NJ (US); Irina A. Ivanter, Sayreville, NJ (US); Mark J. Geusic, Basking Ridge, NJ (US)

(73) Assignee: United States Filter Corporation, Palm Desert, CA (US)

( * ) Notice: Subject to any disclaimer, the term of this patent is extended or adjusted under 35 U.S.C. 154(b) by 0 days.

(21) Appl. No.: 09/778,445

(22) Filed: Feb. 6, 2001

(65) Prior Publication Data

US 2002/0148736 A1 Oct. 17, 2002

(51) Int. Cl.[7] ..... C25B 1/26

(52) U.S. Cl. ..... 205/503; 205/505; 204/290.01; 204/290.06; 204/290.08; 204/290.09; 204/290.12; 204/290.14; 204/291

(58) Field of Search ..... 204/290.01, 290.06, 204/290.08, 290.09, 290.12, 290.14, 503, 505; 205/473, 474, 618, 619, 620, 621, 622, 625

(56) References Cited

U.S. PATENT DOCUMENTS

| | | | | |
|---|---|---|---|---|
| 3,732,157 A | | 5/1973 | Dewitt | |
| 3,751,296 A | | 8/1973 | Beer | |
| 3,770,613 A | | 11/1973 | Chisholm | |
| 3,864,163 A | | 2/1975 | Beer | |
| 3,873,438 A | | 3/1975 | Anderson et al. | |
| 3,875,043 A | * | 4/1975 | Franks et al. | 204/290.01 |
| 4,046,653 A | | 9/1977 | de Nora et al. | |
| 4,088,550 A | | 5/1978 | Malkin | |
| 4,146,438 A | | 3/1979 | de Nora et al. | |
| 4,248,690 A | | 2/1981 | Conkling | |
| 4,481,097 A | | 11/1984 | Asano et al. | |
| 4,528,084 A | | 7/1985 | Beer et al. | |
| 4,584,084 A | | 4/1986 | Asano et al. | |
| 4,585,540 A | | 4/1986 | Beer et al. | |
| 4,626,334 A | | 12/1986 | Ohe et al. | |
| 4,705,610 A | | 11/1987 | Tenhover et al. | |
| 4,783,246 A | | 11/1988 | Langeland et al. | |
| 4,790,923 A | | 12/1988 | Stillman | |
| 4,797,182 A | | 1/1989 | Beer et al. | |
| 5,017,276 A | | 5/1991 | Alford et al. | |
| 5,290,415 A | | 3/1994 | Shimamune et al. | |
| 5,294,317 A | | 3/1994 | Saito et al. | |
| 5,314,601 A | | 5/1994 | Hardee et al. | |
| 5,334,293 A | | 8/1994 | Cairns et al. | |
| 5,429,723 A | | 7/1995 | Atkinson | |
| 5,435,896 A | | 7/1995 | Hardee et al. | |
| 5,679,239 A | | 10/1997 | Blum et al. | |
| 5,868,911 A | | 2/1999 | Blum et al. | |
| 5,868,913 A | | 2/1999 | Hodgson | |
| 5,885,426 A | | 3/1999 | Silveri | |
| 6,120,659 A | | 9/2000 | Kim | |
| 6,123,816 A | | 9/2000 | Hodgson | |
| 6,165,343 A | | 12/2000 | Blum et al. | |
| 6,217,729 B1 | | 4/2001 | Zolotarsky et al. | |

FOREIGN PATENT DOCUMENTS

| | | |
|---|---|---|
| CA | 2166494 | 4/1997 |
| EP | 0344378 | 6/1992 |

* cited by examiner

*Primary Examiner*—Bruce F. Bell
(74) *Attorney, Agent, or Firm*—Wolf, Greenfield & Sacks, P.C.

(57) ABSTRACT

An electrolytic cell producing sodium chlorate uses an electrode, specifically an anode, having a surface or coating or treatment of a mixed metal oxide having ruthenium oxide as an electrocatalyst, a precious metal of the platinum group or its oxide as a stability enhancer, antimony oxide as an oxygen suppressant and a titanium oxide binder. The electrocatalytic coating is about 21 mole percent ruthenium oxide, about 2 mole percent iridium oxide, about 4 mole percent antimony oxide and the balance is titanium oxide. The coating is characterized by high durability and low oxygen content in an off-gas.

52 Claims, 5 Drawing Sheets

ELECTRODE COATING AND METHOD OF USE AND PREPARATION THEREOF

BACKGROUND OF THE INVENTION

1. Field of the Invention

The present invention relates to electrode coatings and, more particularly, to the use of electrode coatings in electrolytic cells for sodium chlorate production and its method of preparation.

2. Description of the Related Art

An electrolytic cell is an electrochemical device that may be used to overcome a positive free energy and force a chemical reaction in the desired direction. For example, Stillman, in U.S. Pat. No. 4,790,923, and Silveri, in U.S. Pat. No. 5,885,426, describe an electrolytic cell for producing a halogen.

Other uses for an electrolytic cell include, for example, the electrolysis of an alkali halide solution to produce an alkali metal halate. In particular, sodium chloride (NaCl) solution may be electrolyzed to produce sodium chlorate ($NaClO_3$) according to the general reaction:

$$NaCl+3H_2O \rightarrow NaClO_3+3H_2 \quad (1)$$

One effort to create such an apparatus has been described by de Nora et al., in U.S. Pat. No. 4,046,653, to produce sodium chlorate.

The design of electrolytic cells depends on several factors including, for example, construction and operating costs, desired product, electrical, chemical and transport properties, electrode materials, shapes and surface properties, electrolyte pH and temperature, competing undesirable reactions and undesirable by-products. Some efforts have focused on developing electrode coatings. For example, Beer et al., in U.S. Pat. Nos. 3,751,296, 3,864,163 and 4,528,084 teach of an electrode coating and method of preparation thereof. Also, Chisholm, in U.S. Pat. No. 3,770,613, Franks et al., in U.S. Pat. No. 3,875,043, Ohe et al., in U.S. Pat. No. 4,626,334, Cairns et al., in U.S. Pat. No. 5,334,293, Hodgson, in U.S. Pat. No. 6,123,816, Tenhover et al., in U.S. Pat. No. 4,705,610, and de Nora et al., in U.S. Pat. No. 4,146,438, disclose other electrodes. And, Alford et al., in U.S. Pat. No. 5,017,276, teach a metal electrode with a coating consisting essentially of a mixed oxide compound comprising ruthenium oxide with a compound of the general formula $ABO_4$ and titanium oxide. In the $ABO_4$ compound, A is a trivalent metal and B is antimony or tantalum.

Although these efforts may have produced some desirable electrode properties, other enhancements remain desirable.

SUMMARY OF THE INVENTION

In accordance with one embodiment, the invention provides an electrode comprising an electrically conductive substrate with an electrocatalytic coating covering at least a portion of a surface of the electrically conductive substrate. The electrocatalytic coating comprises an electrocatalytic agent comprising at least one of a precious metal, a precious metal oxide, a platinum group metal and a platinum group metal oxide, a stability enhancing agent comprising at least one of a precious metal, a precious metal oxide, a platinum group metal and a platinum group metal oxide, an oxygen suppressant agent comprising at least one of a Group V-A metal and a Group V-A metal oxide and an electroconductive binder comprising at least one of a valve metal and a valve metal oxide.

The invention also provides an electrolytic cell comprising an electrolyte in a cell compartment, an anode and a cathode immersed in the electrolyte and a power source for supplying a current to the anode and the cathode. The anode is coated with a mixture comprising ruthenium oxide, at least one of a platinum group metal and a platinum group metal oxide, antimony oxide and a valve metal oxide.

In another embodiment, the invention provides a method of producing sodium chlorate comprising supplying an electrolyte comprising sodium chloride to an electrolytic cell comprising electrodes with an electrocatalytic coating of a mixture comprising at least one of a metal and a metal oxide suppressing oxygen generation and at least one of a metal and a metal oxide enhancing coating stability. The method further comprises applying a current to the electrodes and recovering sodium chlorate from the electrolytic cell.

In yet another embodiment, the invention provides a method of coating an electrode comprising preparing a homogeneous mixture of salts of ruthenium, at least one of a precious metal and a platinum group metal, antimony and a valve metal, applying a layer of the homogeneous mixture on at least a portion of a surface of the electrode, drying the layer and heat treating the layer to form an electrocatalytic coating on the electrode.

In yet another embodiment, the invention provides an electrode comprising an electrocatalytic coating comprising about 10 to about 30 mole percent ruthenium oxide, about 0.1 to about 10 mole percent iridium oxide, about 0.5 to about 10 mole percent antimony oxide and titanium oxide.

BRIEF DESCRIPTION OF THE DRAWINGS

Preferred, non-limiting embodiments of the present invention will be described by way of examples with reference to the accompanying drawings, in which.

DETAILED DESCRIPTION OF THE INVENTION

Figure 1:
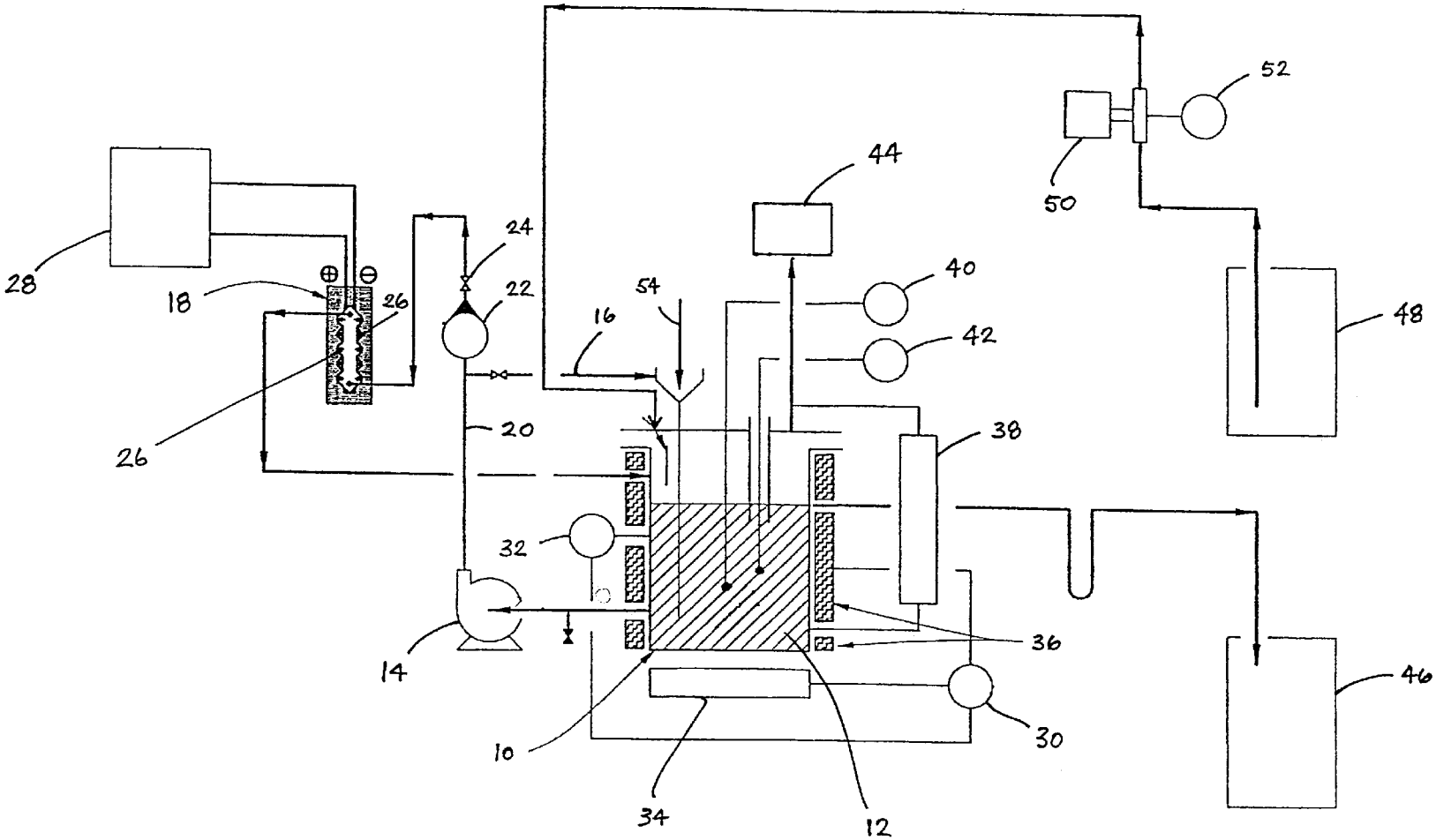
FIG. 1 is a schematic diagram of one embodiment a sodium chlorate test cell system of the present invention.

The invention is directed to an electrode, having an electrocatalytic surface or an electrocatalytic coating, used in electrolytic cells to produce sodium chlorate. The electrode may have a substrate, preferably an electrically conductive substrate and more preferably a titanium or carbon, typically as graphite, substrate. The electrocatalytic surface or coating is typically a mixture of ruthenium oxide, a platinum group metal or a platinum group metal oxide, antimony oxide and a valve metal oxide.

The various aspects and embodiments of the invention can be better understood with the following definitions. As used herein, an "electrolytic cell" generally refers to an apparatus that converts electrical energy into chemical energy or produces chemical products through a chemical reaction. The electrolytic cell may have "electrodes," typically two metal electrodes, which are electrically conducting materials and which may be immersed in an "electrolyte" or a solution of charged ions typically formed by dissolving a chemically dissociable compound such as a salt, acid or base. "Current density" is defined as the current passing through an electrode per unit area of the electrode. Typically, the current is a direct current which is a continuous unidirectional current flow rather an alternating current, which is an oscillating current flow. Notably, reversing the polarity of the potential or voltage involves changing the direction of the applied current flowing through the electrolytic cell.

The reactions in the cell typically involve at least one oxidation reaction and at least one reduction reaction where the material or compound loosing an electron or electrons is being oxidized and the material gaining an electron or electrons is being reduced. An "anode" is any surface around which oxidation reactions occur and is typically the positive electrode in an electrolytic cell. A "cathode" is any surface around which reduction reactions typically occur and is typically the negative electrode in an electrolytic cell. "Electrocatalysis" is the process of increasing the rate of an electrochemical reaction. Hence, an electrocatalytic material increases the rate of an electrochemical reaction. In contrast, passivation is the process whereby a material looses its active properties including, for example, its electrocatalytic properties.

"Selectivity" is the degree to which a material prefers one property to others or the degree to which a material promotes one reaction over others. "Stability" refers to the ability of a material to resist degradation or to maintain its desired operative properties. "Platinum group metals" are those metals typically in the Group VIII of the periodic table including ruthenium, rhodium, palladium, osmium, iridium, and platinum. "Valve metals" are any of the transition metals of Group IV and V of the periodic table including titanium, vanadium, zirconium, niobium, hafnium and tantalum.

Generally, in an electrolytic cell designed to produce sodium chlorate, the following reactions typically occur:

At the Anode $$Cl^- \rightarrow \tfrac{1}{2}Cl_2 + e \quad (2)$$

$$6ClO^- + 3H_2O \rightarrow 2ClO_3^- + 4Cl^- + 6H^+ + 1\tfrac{1}{2}O_2 + 6e \quad (3)$$

$$2H_2O \rightarrow O_2 + 4H^+ + 4e \quad (4)$$

$$ClO_3^- + H_2O \rightarrow ClO_4^- + 2H^+ + 2e \quad (5)$$

In the Electrolyte $$Cl_2 + OH^- \leftrightarrows HClO + Cl^- \quad (6)$$

$$HClO \leftrightarrows ClO^- + H^+ \quad (7)$$

$$2HClO + ClO^- \rightarrow ClO_3^- + 2Cl^- + 2H^+ \quad (8)$$

$$2ClO^- \rightarrow 2Cl^- + O_2 \quad (9)$$

At the Cathode $$H_2O + e \rightarrow OH^- + \tfrac{1}{2}H_2 \quad (10)$$

$$ClO^- + H_2O + 2e \rightarrow Cl^- + 2OH^- \quad (11)$$

$$ClO_3^- + 3H_2O + 6e \rightarrow Cl^- + 6OH^- \quad (12)$$

The electrode provided by the invention is formed with a substrate or core having an electrocatalytic coating. Thus in one embodiment, a coating or other outer covering, having electrocatalytic properties, is applied on a substrate to create an electrode.

The surface or coating of the electrode is preferably a material that promotes an electrochemical reaction and, more preferably, it electrocatalyzes a desired chemical reaction and inhibits any undesired chemical reaction or suppresses any undesired by-product. Further, the electrocatalytic surface or coat preferably provides electrode stability such that it significantly extends the service life or useful operating life of the electrode. For example, the electrocatalytic surface may catalyze the electrolysis of an alkali metal halide solution to an alkali halate while selectively inhibiting competing undesired reaction. Preferably, the electrocatalytic surface catalyzes the electrolysis of sodium chloride solution or brine, to sodium chlorate in an electrochemical device according to equation (1). Also preferably, the surface suppresses oxygen generation from equation (4). Further, the electrocatalytic surface preferably provides improved electrode stability by increasing the electrode operating life.

Thus, in one embodiment, the coating or surface of the electrode is a mixture comprising an electrocatalytic agent, a stability enhancing agent, an oxygen suppressant agent and an electroconductive binder. Notably, the coating may comprise of several applied layers of the mixture on a substrate. Preferably, the electrocatalytic agent is a metal or its oxide favoring sodium chlorate production, the suppressant suppresses oxygen generation, the stability enhancement imparts long-term durability and the binder provides a carrier matrix. More preferably, the electrocatalytic agent is a precious metal, a precious metal oxide, a platinum group metal or a platinum group metal oxide, the stability enhancement agent is a precious metal, a precious metal oxide, a platinum group metal or a platinum group metal oxide, the suppressant is a Group V-A metal or a Group V-A metal oxide and the binder is a valve metal or a valve metal oxide. More preferably still, the mixture comprises of a platinum group metal oxide, another platinum group metal oxide, a Group V-A metal oxide and a valve metal oxide. More preferably still, the electrocatalytic agent is ruthenium oxide, the stability enhancing agent is tetravalent iridium oxide, the oxygen suppressant is pentavalent antimony oxide and the electroconductive binder is titanium oxide. And more preferably still, the amount of ruthenium oxide in the mixture is about 10 to about 30 mole percent; the amount of iridium oxide in the mixture is about 0.1 to about 10 mole percent; the amount of antimony oxide in the mixture is about 0.5 to about 10 mole percent; and the balance is titanium oxide.

In one embodiment of the invention, the electrolytic cell also has a power source for supplying a direct current to the electrodes of the electrolytic cell. Specifically, in one current direction, one electrode typically acts as the anode and its counterpart typically acts as the cathode. In yet another embodiment of the invention, the electrolytic cell may be designed for a current with changing or reversing polarity. For example, the electrolytic cell may have a timer actuating the positions of switches connecting each terminal of the power source to the electrodes. Thus in one arrangement, the timer opens or closes the switches so that one electrode is the anode and another is the cathode for a predetermined time and then repositions the switches so that the electrode formerly acting as an anode subsequently acts as the cathode and, similarly, the electrode formerly acting as the cathode subsequently acts as the anode because the direction of the direct current flow, the polarity, is reversed.

In another embodiment, the electrolytic cell may further include a controller and a sensor that supervises the change in current direction. For example, the direction of the applied current may be changed when a measured process condition, such as the concentration of the sodium chlorate, of the electrolytic cell, as measured by a sensor, has reached a predetermined value. Notably, the electrolytic cell may include a combination of sensors providing signals to the controller or a control system. In turn, the control system may include a control loop employing one or more control protocols such as proportional, differential, integral or a combination thereof or even fuzzy logic or artificial intelligence. Thus, the control system supervises the operation of the electrolytic cell to maximize any one of conversion, yield, efficiency and electrode life.

In an embodiment related to coating the substrate, the substrate, a titanium substrate for example, may be cleaned in a cleaning bath apparatus to remove or minimize contaminants that may hinder proper adhesion of the coating to the substrate surface. For example, the substrate may be placed in the alkaline bath for at least 20 minutes at a temperature of at least 50° C. The substrate surface may then be rinsed with deionized (DI) water and air-dried. Preferably, the substrate surface is further treated by grit blasting with aluminum oxide grit or by chemical etching. The chemical etching may comprise washing the substrate surface with an acid, such as oxalic, sulfuric, hydrochloric or a combination thereof, at a temperature of at least about 40° for several minutes, preferably several hours, depending on the desired substrate surface characteristics. Further, the chemical etch may be followed by one or several DI water rinses.

Salts of the precious metal, platinum group metal, valve metal and the Group V-A metal are typically dissolved in an alcohol to produce a homogeneous alcohol salt mixture to be applied to the substrate surface. In one embodiment, the alcoholic salt mixture is prepared by dissolving chloride salts of iridium, ruthenium, antimony and titanium in n-butanol. This alcoholic salt mixture may be applied to the cleaned substrate surface. Typically, each application produces a coat of about 1 to 6 g/m$^2$ (dry basis). The wet coated substrates are typically allowed to air dry before being heat-treated. The heat treatment typically comprises placing the air-dried substrate in a furnace for at least about 20 minutes at a temperature of at least about 400° C. The alcoholic salt mixture may be reapplied several times to obtain a total coating loading of at least 10 g/m$^2$ and preferably, at least 15 g/m$^2$ and more preferably still, at least 25 g/m$^2$. After the last application and heat treating, the coated substrate typically receives a final thermal treatment at a temperature sufficient to oxidize the salts. For example, the final thermal treatment may be performed at a temperature of at least 400° C.

The invention may be further understood with reference to the following examples. The examples are intended to serve as illustrations and not as limitations of the present invention as defined in the claims herein.

EXAMPLE 1

An electrode with an electrocatalytic surface embodying features of the invention was prepared by coating a substrate of commercial Grade 2 titanium. The titanium substrate was cleaned in a commercially available alkaline cleaning bath for 20 minutes at a temperature of 50° C. and then rinsed with DI water. After air drying, the substrate was etched in 10% by weight aqueous oxalic acid solution at 60° to 80° C.

A mixture of salts of iridium, antimony, ruthenium, and titanium was prepared by dissolving 0.7 g of chloroiridic acid ($H_2IrCl_6.4H_2O$), 2.0 g of antimony chloride ($SbCl_3$), 4.1 g of ruthenium chloride ($RuCl_3.3H_2O$) and 20 ml of titanium tetraorthobutanate ($Ti(C_4H_9O)_4$) in 1.0 ml of DI water and 79 ml of butanol. This mixture was applied to the cleaned substrate to achieve a loading of about 1 to 6 g/m$^2$ per coat on a dry basis. The wet coated substrate was allowed to air dry before being placed in a furnace where it was heat treated for 10 to 40 minutes at a temperature of 450° C.

The mixture was reapplied several times to obtain a total coating loading of at least 10 g/m$^2$. After the last application, the coated substrate was thermally treated for about one hour at a temperature of about 450° C.

The surface of the electrode had the following composition, in mole percent:

| | |
|---|---|
| Ruthenium oxide, $RuO_2$ | 20.8 |
| Iridium oxide, $IrO_2$ | 1.8 |
| Antimony oxide, $Sb_2O_5$ | 4.3 |
| Titanium oxide, $TiO_2$ | 73.1 |

EXAMPLE 2

The electrode prepared according to Example 1 was evaluated as an anode in a sodium chlorate test cell system schematically illustrated in FIG. 1. In the test cell system, a cell compartment 10 contained a brine electrolyte 12. The electrolyte was continuously circulated by circulation pump 14 through circulation line 16 to maintain homogeneity of electrolyte 12. Part of the electrolyte flowing through circulation pump 14 flowed to an electrolytic cell 18 through conduit 20.

The flow rate into cell 18 was measured by a flowmeter 22 and controlled by adjusting a cell flow valve 24. Electrolytic cell 18 had electrodes 26 with an applied potential of about 4 volts (V) and current of about 30 amperes (A) from a power supply 28. In the electrolytic cell, a portion of electrolyte 12 was electrolyzed according to reaction (1) to produce sodium chlorate. The electrode area was 100 cm$^2$. The electrode gap, the spacing between the anode and the cathode, was 2 mm. The cathode was made from STAHR-MET™ steel. Electrolyte 12 leaving cell 18 was reintroduced into compartment 10.

The temperature of electrolyte 12 was maintained by a temperature control system 30 which received input from a temperature sensor 32 and controlled a heater 34 and a heating jacket 36 surrounding compartment 10. The test cell system also included other process measurement devices including a level indicator 38, a temperature indicator 40 and a pH indicator 42.

Off-gas containing gaseous products resulting from reactions (2) to (12) would leave compartment 10 and would be analyzed in a Teledyne Model 320P oxygen analyzer 44. Sodium chlorate product was retrieved by transferring a portion of electrolyte to liquor receiver 46. Brine from brine storage tank 48 was pumped by brine feed pump 50 into compartment 10. The brine electrolyte level was maintained by adjusting the brine flow rate with brine flow control 52.

Additional chemicals, sodium dichromate ($Na_2Cr_2O_7$) for example, were added through chemical inlet 54.

The test system was continuously operated under the following conditions:

| | |
|---|---|
| Temperature: | 80° C. |
| Current density: | 3.0 KA/$m^2$ |
| pH: | 6.1 |
| Interelectrode gap: | 2.0 mm |
| Electrolyte flowrate: | 0.5 L/Ah |
| Electrolyte composition: | 100 gpl NaCl |
| (in grams per liter) | 500 gpl $NaClO_3$ |
| | 3.5 gpl $Na_2Cr_2O_7$ |

The following measurements were performed:

NaCl concentration by Mohr titration $NaClO_3$ concentration by iodometry

Electrolyte pH

Cell voltage

Figure 2:
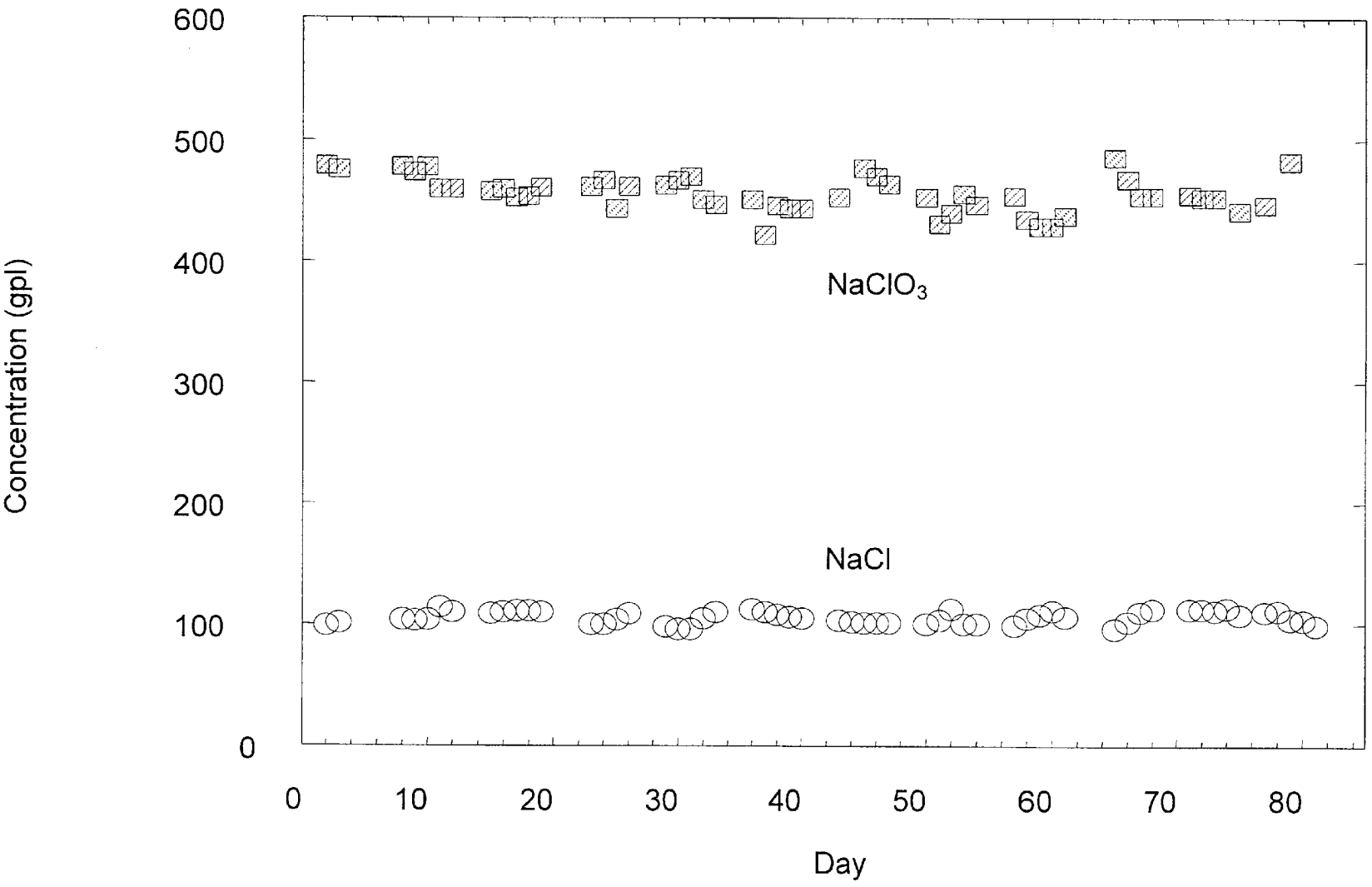
FIG. 2 is a graph of the sodium chlorate and sodium chloride concentrations during a test period of the sodium chlorate test cell system of FIG. 1.
Figure 3:
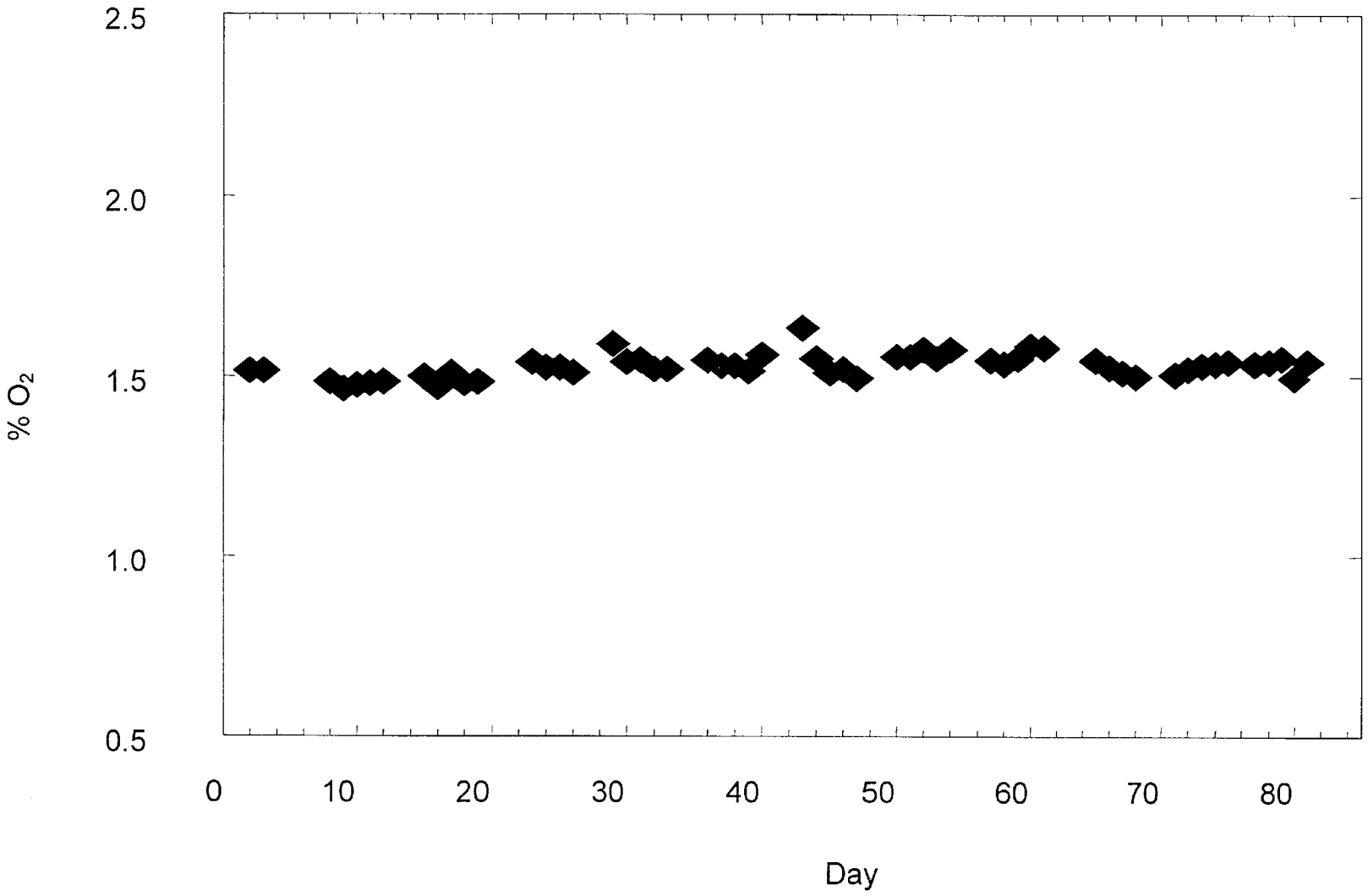
FIG. 3 is a graph of the oxygen concentration in the off-gas during a test period of the sodium chlorate test cell system of FIG. 1.
Figure 4:
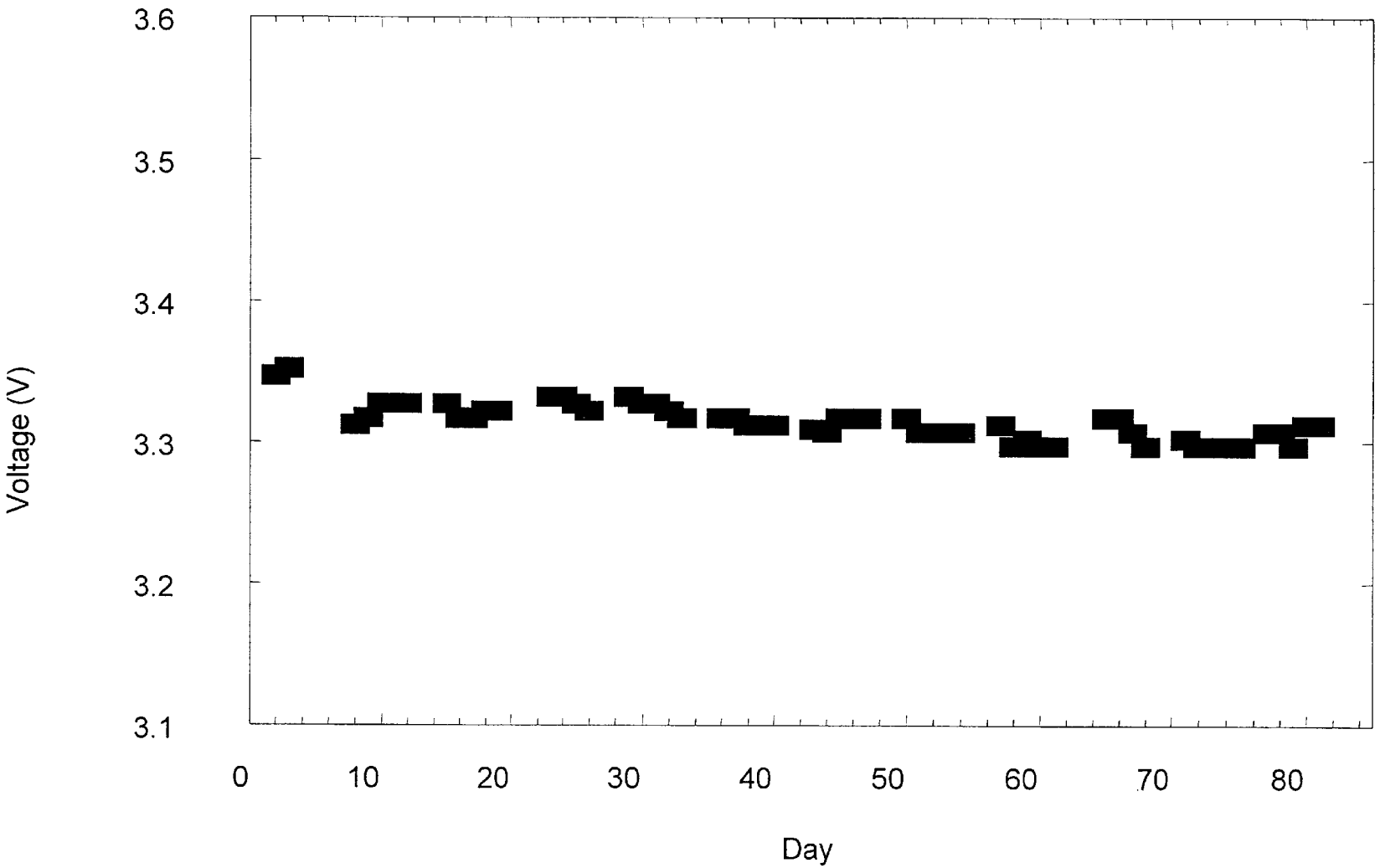
FIG. 4 is a graph of the measured voltage potential across the electrodes of the sodium chlorate test cell system of FIG. 1 during a test period.

FIGS. 2–4 graphically present the test results. FIG. 2 shows a stable rate of sodium chlorate production throughout the test duration. FIG. 3 shows that the off-gas generated by the electrolytic cell was about 1.5% oxygen during the test period. Moreover, FIG. 4 shows the stability of the voltage during the test period. In summary, the test cell producing sodium chlorate performed steadily with no or minimal passivation for over 80 days and generating, on the average, was about 1.5% oxygen and with sufficient voltage stability at about 3.3 V.

EXAMPLE 3

The electrode prepared according to Example 1 was evaluated as an anode in an accelerated anode aging test cell similar to the one described in Example 2 and schematically illustrated in FIG. 1. In this example, the service life or lifetime of the electrode coating prepared in Example 1 was compared against the service life or lifetime of commercially available electrode coatings under accelerated wear conditions. The test system was continuously operated under the following conditions:

| | |
|---|---|
| Electrolyte: | 1.85 M $HClO_4$, |
| | 0.25 M NaCl |
| Initial current density: | 8.6 KA/$m^2$ |
| Temperature: | 30° C. |

In the beginning of each accelerated wear test, the test cell was run in a galvanostatic mode at 3.9 A. When the cell voltage of 4.5 V was reached, the test was switched into a potentiostatic mode and this voltage was maintained throughout the remaining duration of the test. The current was measured periodically until it reached 1.0 A, at which point the electrode coatings were considered to have failed. The service life or lifetime of each electrode coating was defined as the time required for the applied current to fall from the initial value of 3.9 A to a failed value of 1.0 A.

Figure 5:
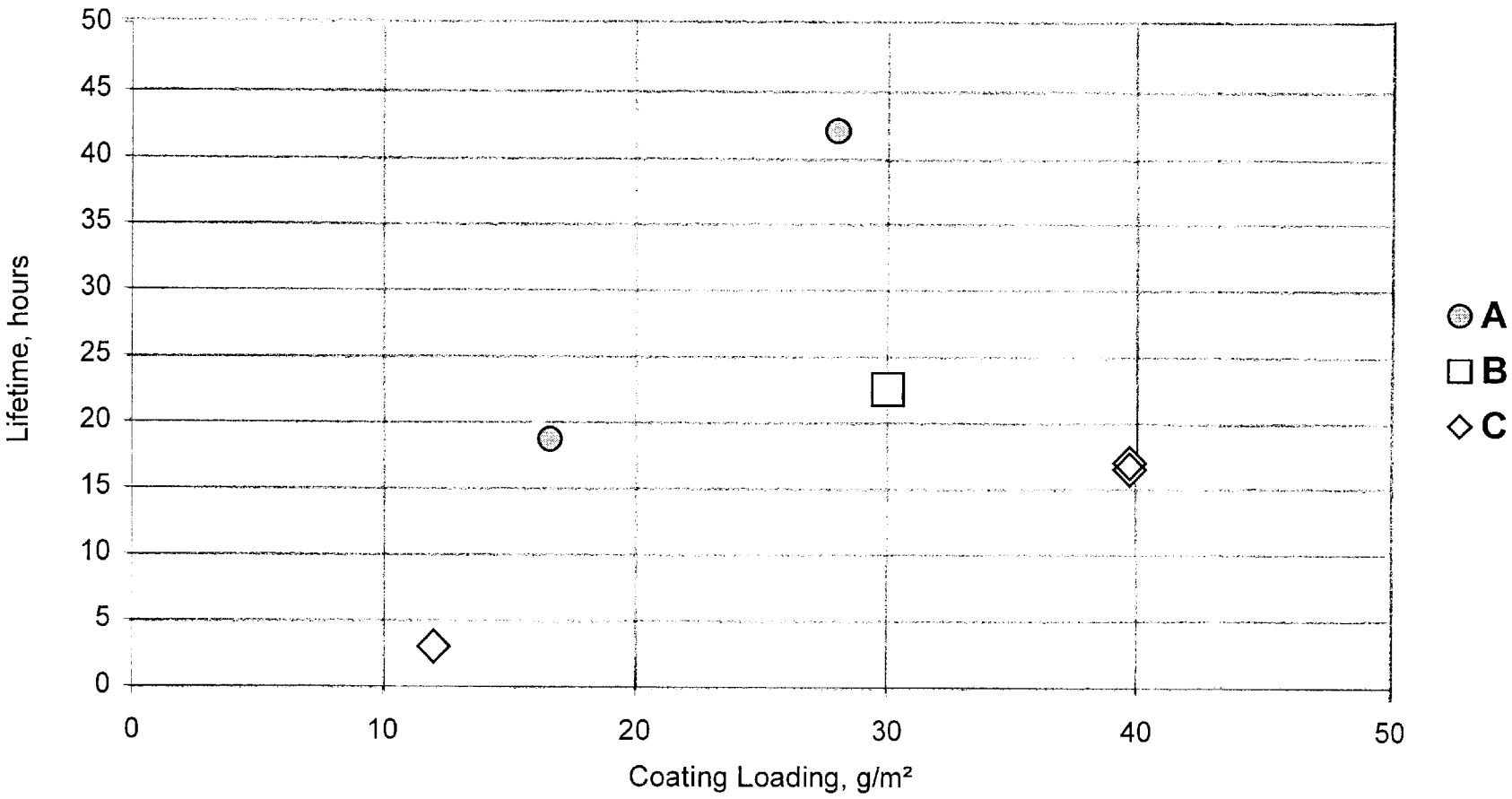
FIG. 5 is a graph of the lifetime in hours of the electrode coating as influenced by coating loading.

In FIG. 5, the electrode coating prepared in Example 1 was labeled as "A." Two other commercially available electrodes were evaluated. In particular, the electrode coating labeled as "B" had a composition of 30 mole percent ruthenium oxide and 70 mole percent titanium oxide, which is typically referred to in the industry as dimensionally stable anode coating. The coating labeled "C" was also evaluated. This latter coating is the coating previously described by Alford et al. in U.S. Pat. No. 5,017,276.

FIG. 5 shows the improved stability of the coating of the invention. In particular, the coating of the invention shows a lifetime of greater than 40 hours for a coating loading of about 28 g/$m^2$. In comparison, the B coating had a lifetime of about 22 hours at a comparable coating loading. FIG. 5 also shows that the coating of the invention also outperformed the coating disclosed by Alford et al. Thus, the coating of the present invention represents a significant improvement in coating stability.

Further modifications and equivalents of the invention herein disclosed will occur to persons skilled in the art using no more than routine experimentation and all such modifications and equivalents are believed to be within the spirit and scope of the invention as defined by the following claims.

What is claimed is:

1. An electrode comprising:

an electrically conductive substrate; and an electrocatalytic coating covering at least a portion of a surface of the electrically conductive substrate, wherein the electrocatalytic coating comprises an electrocatalytic agent comprising at least one of a precious metal, a precious metal oxide, a platinum group metal and a platinum group metal oxide, a stability enhancing agent comprising at least one of a precious metal, a precious metal oxide, a platinum group metal and a platinum group metal oxide, an oxygen suppressant agent comprising at least one of a Group V-A metal and a Group V-A metal oxide, and an electroconductive binder comprising at least one of a valve metal and a valve metal oxide.

2. The electrode as in claim 1, wherein the electrically conductive substrate comprises at least one of titanium and graphite.

3. The electrode as in claim 2, wherein the electrocatalytic agent is ruthenium oxide.

4. The electrode as in claim 3, wherein the stability enhancing agent is at least one of iridium oxide and platinum oxide.

5. The electrode as in claim 4, wherein the stability enhancing agent is iridium oxide.

6. The electrode as in claim 5, wherein the oxygen suppressant agent is antimony oxide.

7. The electrode as in claim 6, wherein the electrocatalytic coating is about 0.1 to about 10 mole percent iridium oxide.

8. The electrode as in claim 7, wherein the electrocatalytic coating is about 0.5 to about 10 mole percent antimony oxide.

9. The electrode as in claim 8, wherein the electrocatalytic coating is about 10 to 30 mole percent ruthenium oxide.

10. The electrode as in claim 9, wherein the electrocatalytic coating is about 2 mole percent iridium oxide.

11. The electrode as in claim 10, wherein the electrocatalytic coating is about 4 mole percent antimony oxide.

12. The electrode as in claim 11, wherein the electrocatalytic coating is about 21 mole percent ruthenium oxide.

13. The electrode as in claim 12, wherein the electroconductive binder is titanium oxide.

14. The electrode as in claim 13, wherein the electrocatalytic coating is applied at a total coating load of at least 10 g/$m^2$.

15. The electrode as in claim 14, wherein the total coating load is at least 15 g/$m^2$.

16. An electrolytic cell comprising:

an electrolyte in a cell compartment;

an anode and a cathode immersed in the electrolyte; and a power source for supplying a current to the anode and the cathode, wherein the anode is coated with a mixture consisting essentially of ruthenium oxide, at least one of a platinum group metal and a platinum group metal oxide, antimony oxide and a valve metal oxide.

17. The electrolytic cell as in claim 16, wherein the mixture is about 0.1 to about 10 mole percent iridium oxide.

18. The electrolytic cell as in claim 17, wherein the mixture is about 0.5 to about 10 mole percent antimony oxide.

19. The electrolytic cell as in claim 18, wherein the mixture is about 10 to about 30 mole percent ruthenium oxide.

20. The electrolytic cell as in claim 19, wherein the mixture is about 2 mole percent iridium oxide.

21. The electrolytic cell as in claim 20, wherein the mixture is about 4 mole percent antimony oxide.

22. The electrolytic cell as in claim 21, wherein the mixture is about 21 mole percent ruthenium oxide.

23. The electrolytic cell as in claim 22, wherein the mixture is applied at a total loading of at least 10 $g/m^2$.

24. The electrolytic cell as in claim 23, wherein the total loading is at least 15 $g/m^2$.

25. The electrolytic cell as in claim 22, wherein the cathode is coated with the mixture.

26. The electrolytic cell as in claim 25, further comprising means for changing a direction of the current.

27. A method of producing sodium chlorate comprising:

supplying an electrolyte comprising sodium chloride to an electrolytic cell comprising electrodes with an electrocatalytic coating of a mixture comprising at least one of a metal and a metal oxide suppressing oxygen generation and at least one of a metal and a metal oxide enhancing coating stability;

applying a current to the electrodes; and recovering sodium chlorate from the electrolytic cell.

28. The method of claim 27, further comprising the step of producing an off-gas having about 1.5% oxygen.

29. The method of claim 28, wherein the electrocatalytic coating comprises antimony oxide.

30. The method of claim 29, wherein the electrocatalytic coating comprises at least one of a precious metal, a precious metal oxide, a platinum group metal and a platinum group metal oxide.

31. The method of claim 30, wherein the electrocatalytic coating further comprises ruthenium oxide.

32. The method of claim 31, wherein the electrocatalytic coating further comprises a binder.

33. The method of claim 32, wherein the binder is a valve metal oxide.

34. The method of claim 33, wherein the valve metal oxide is titanium oxide.

35. The method of claim 34, wherein the electrocatalytic coating comprises iridium oxide.

36. The method of claim 35, wherein the electrocatalytic coating is about 0.1 to about 10 mole percent iridium oxide.

37. The method of claim 36, wherein the electrocatalytic coating is about 0.5 to about 10 mole percent antimony oxide.

38. The method of claim 37, wherein the electrocatalytic coating is about 10 to about 30 mole percent ruthenium oxide.

39. The method of claim 38, wherein the electrocatalytic coating is about 2 mole percent iridium oxide.

40. The method of claim 39, wherein the electrocatalytic coating is about 4 mole percent antimony oxide.

41. The method of claim 40, wherein the electrocatalytic coating is about 21 mole percent ruthenium oxide.

42. The method of claim 41, wherein the electrocatalytic coating is applied at a total coating load of at least 10 $g/m^2$.

43. The method of claim 42, wherein the total coating load is at least 15 $g/m^2$.

44. An electrode consisting essentially of:

an electrically conductive substrate; and an electrocatalytic coating covering at least a portion of a surface of the electrically conductive substrate, wherein the electrocatalytic coating comprises an electrocatalytic agent comprising at least one of a precious metal, a precious metal oxide, a platinum group metal and a platinum group metal oxide, a stability enhancing agent comprising at least one of a precious metal, a precious metal oxide, a platinum group metal and a platinum group metal oxide, an oxygen suppress ant agent comprising at least one of a Group V-A metal and a Group V-A metal oxide, and an electroconductive binder comprising at least one of a valve metal and a valve metal oxide.

45. The electrode as in claim 44, wherein the electrocatalytic agent is ruthenium oxide.

46. The electrode as in claim 44, wherein the stability enhancing agent is at least one of iridium oxide and platinum oxide.

47. A system for producing chlorate comprising:

a brine storage tank;

a fluid compartment fluidly connected to the brine storage tank;

an electrolytic cell fluidly connected to the fluid compartment and comprising an electrode coated with a mixture consisting essentially of ruthenium oxide, a platinum group metal oxide, a valve metal oxide, and antimony oxide; and a receiver fluidly connected to the fluid compartment.

48. The system of claim 47, further comprising a dichromate source connected to the fluid compartment.

49. The system of claim 47, further comprising a circulation line fluidly connected to the fluid compartment.

50. The system of claim 47, further comprising a temperature control system regulating a temperature of a brine solution in the fluid compartment.

51. The system of claim 47, wherein the platinum group metal oxide is iridium oxide.

52. The system of claim 51, wherein the valve metal oxide is titanium oxide.

* * * * *